US005177403A

United States Patent [19]

Kawaguchi et al.

[11] Patent Number: 5,177,403

[45] Date of Patent: Jan. 5, 1993

[54] MICROWAVE OVEN MAGNETRON HAVING CHOKING STRUCTURE AND LEAKAGE FLUX COMPENSATION MEANS

[75] Inventors: Toshio Kawaguchi; Akira Kousaka, both of Yokohama, Japan

[73] Assignee: Kabushiki Kaisha Toshiba, Kawasaki, Japan

[21] Appl. No.: 605,847

[22] Filed: Oct. 30, 1990

[30] Foreign Application Priority Data

Oct. 31, 1989 [JP] Japan ..... 1-281695
Oct. 31, 1989 [JP] Japan ..... 1-281701
Oct. 31, 1989 [JP] Japan ..... 1-281702

[51] Int. Cl.[5] ..... H01J 25/50
[52] U.S. Cl. ..... 315/39.71; 315/39.53
[58] Field of Search ..... 315/39.51, 39.53, 39.71, 315/39.75; 331/86, 91

[56] References Cited

U.S. PATENT DOCUMENTS 3,794,879 2/1974 Edwards ..... 315/39.51 X
4,006,382 2/1977 Butler et al. ..... 315/39.53
4,205,250 5/1980 Ohara ..... 315/39 X
4,207,496 6/1980 Nakai ..... 315/39.53
4,282,459 8/1981 Oguro ..... 315/39.51 X

FOREIGN PATENT DOCUMENTS 0205316 12/1986 European Pat. Off. .
28366 3/1978 Japan ..... 315/39.71
61-281433 12/1986 Japan .
62-122028 6/1987 Japan .
93031 4/1989 Japan ..... 315/39.51

OTHER PUBLICATIONS

J. R. M. Vaughn, "Some High-Power Window Failures", Transactions of the IRE, Professional Group on Electron Devices, Jul. 1961, IEEE Inc., New York, pp. 302-308.

D. H. Priest, "Multipactor Motions in Microwave Tubes", Proceedings of the International Congress on Microwave Tubes, 1963, Scheveningen, 3-7 Sep. 1962, pp. 34-40.

*Primary Examiner*—Paul M. Dzierzynski
*Assistant Examiner*—Benny T. Lee
*Attorney, Agent, or Firm*—Cushman, Darby & Cushman

[57] ABSTRACT

In a microwave oven magnetron, a first metal cylinder and a ring-like permanent magnet are provided on a magnetron body. Second and third metal cylinders are coaxially arranged in the first metal cylinder so that choking grooves for choking second and fourth harmonic waves are formed between the first and second metal cylinders and the second and third metal cylinders. A ferromagnetic cylinder made of iron or iron alloy is arranged around the first metal cylinder. Thus, a magnetic flux supplied from the permanent magnet into a space inside of the second metal cylinder have axial components which are greater than or equal to 400 gauss in over half the inner space.

18 Claims, 11 Drawing Sheets

MICROWAVE OVEN MAGNETRON HAVING CHOKING STRUCTURE AND LEAKAGE FLUX COMPENSATION MEANS

BACKGROUND OF THE INVENTION

1. Field of the Invention

The present invention relates to a microwave oven magnetron having a choking structure and, more particularly, to an improvement in its high frequency output section.

2. Description of the Related Art

A conventional microwave oven magnetron has a structure shown in FIG. 1. An oscillator body 21 of the magnetron shown in FIG. 1 comprises an anode cylinder 22, a plurality of anode vanes 23 fixed inside the anode cylinder 22 and constituting part of a cavity resonator, strap rings 24 for electrically connecting the anode vanes 23, a filament cathode 25 arranged along the axis of the anode cylinder 22, end shields 26 formed at both ends of the filament cathode 25, and pole pieces 27 and 28 fixed to open end portions of the anode cylinder. A cylindrical output section metal vessel 29 is fixed in the anode cylinder 22. An output section ceramic cylinder 31 of a high frequency output section 30 is fixed in the metal vessel 29. A ring 32 for sealing the output distal end portion is arranged inside the high frequency output section 30. A metal exhaust tube 33 is hermetically bonded to the ring 32, and an output section metal cap 34 fits on the ring 32. An output antenna lead 35 is arranged inside the high frequency output section 30. That is, one end portion 35*a* of the antenna lead 35 passes through a through hole 27*a* of a pole piece 27 connected to one of the vanes, and then passes through the metal vessel 29 and the ceramic cylinder 31. A distal end portion 35*b* is clamped and hermetically sealed by the metal exhaust tube 33. A ring-like permanent magnet 36 coaxially surrounds the metal vessel 29 and is magnetically coupled by a ferromagnetic yoke 37. A ferromagnetic thin plate 38 is interposed between the ferromagnetic yoke 37 and the magnet 36, and a net-like conductive gasket 39 is fitted in the inner surface of the ferromagnetic yoke 37. A small-diameter metal cylinder 40 is arranged in the lower end portion of the ceramic cylinder 31, and a large-diameter metal cylinder 41 is arranged to surround the cylinder 40. The metal cylinder 41 is brazed to the distal end portion of the metal vessel 29. A distal end 41*a* of the metal cylinder 41 holds the inner circumferential portion of the gasket 39. With this structure, a $\frac{1}{4}$ wavelength choking groove C2 for chocking the second harmonic wave and a groove C4 for choken the fourth harmonic wave are formed in a discharge tube portion. The metal vessel 29 and two metal cylinders 40 and 41 inside the vessel 29 constitute a groove C3 for choking a third harmonic wave and a groove C5 for choking a fifth harmonic wave. The choking metal cylinders 40 and 41 are formed by ferromagnetic thin-walled cylinders made of iron or an iron alloy. The metal cylinder 40 has an inner diameter D1 smaller than an inner diameter D2 of the ceramic cylinder 31 and has a size smaller than $\frac{1}{2}$ of the fifth harmonic wavelength so as to obtain a sufficient choking action. In this magnetron, a fundamental wave having a frequency of, e.g., 2,450 MHz is efficiently radiated from the output section. However, external radiation of the harmonic components is suppressed by the choking action of each $\frac{1}{4}$ wavelength choke.

In order to obtain the choken of the harmonic components of higher orders such a the fifth harmonic wave, the inner diameter of the harmonic choking metal cylinder 40 must be reduced to a given degree. When the inner diameter is so reduced, a distance s between the choking metal cylinder 40 and the antenna lead 35 passing therethrough is inevitably reduced. When a high frequency voltage which is applied between the metal cylinder 40 and the antenna lead 35, due to reflected wave produced by an impedance of the microwave oven, reaches a predetermined range, high frequency discharge or RF discharge may occur. In the worst case, when rotation of a stirrer fan is stopped due to a certain cause during operation of the microwave oven and an object to be heated as a high frequency load is almost or perfectly absent so that high frequency reflection onto the magnetron may exceed a standing wave ratio (VSWR) of 30, a discharge is generated between the antenna lead and the harmonic choking metal cylinder. In the extreme case, the antenna lead 35 or the choking metal cylinder 40 is partially heated by the high frequency discharge and may be melt. When part of the antenna lead or the choking metal cylinder melts, a gas discharge may be locally generated by a gas generated upon melting of such a member. In addition, the gas discharge may further cause a high frequency short circuit and reflection. Continuous discharges may then occur in the output section or decisive melting of or damage to the components may occur.

These high frequency discharges may be estimated to be multipactor discharge phenomena in most cases. DC magnetic fluxes leaking from the permanent magnet 36 extend parallel to a tube axis Z, as shown by reference symbol F in FIG. 2 in a space between the antenna lead and the harmonic choking metal cylinder. These magnetic fluxes are almost symmetrical about the tube axis. These metal components have a secondary electron emission rate of 1 or more. When free electrons and the like collide against the antenna lead or the inner surface of the choking metal cylinder, many secondary electrons are generated. These electrons are accelerated or decelerated by a high frequency electric field generated between the antenna lead and the metal cylinder. When electrons emitted from one of these conductors encounter a high frequency accelerating electric field, they are accelerated, and the accelerated electrons collide against the other conductor, thereby emitting a larger number of secondary electrons. In this state, when the high frequency electric field is inverted to form an electric field for accelerating these secondary electrons in a direction to the source conductor, i.e., one conductor, the secondary electrons are accelerated and collide against the source conductor, thereby emitting a larger number of secondary electrons. In this manner, when the electrons are synchronized with the high frequency electric field, the secondary electrons are exponentially increased, and their energy is also increased. Then, the conductors are heated and may be melted. This phenomenon is a double-side multipactor discharge phenomenon.

A second problem occurs due to, the electron rotation caused by a DC magnetic field present in this region. When the period of the high frequency electric field i synchronized with the rotation period, secondary electrons e are cumulatively generated, as illustrated in FIG. 3. The collision energy of these secondary electrons causes abrupt heating of the metal cylinder material, and the metal cylinder may. This phenomenon is called a one-side multipactor discharge phenomenon.

SUMMARY OF THE INVENTION

It is an object of the present invention to provide a microwave oven magnetron which can properly suppress generation of a high frequency discharge within a high frequency output section under severe operating conditions.

A microwave oven magnetron according to the present invention comprises:

an anode cylinder having an inner surface and open end portions;

a plurality of anode vanes fixed on the inner surface of the anode cylinder and constituting a cavity resonator and defining an interaction space;

pole pieces fixed on the open end portions of the anode cylinder;

a first metal cylinder having one end and the other end, the one end of the first metal cylinder being provided on the pole piece;

an output section ceramic cylinder coupled to the other end of the first metal cylinder an antenna lead having one end and another end, the one end of the antenna lead being electrically connected to the cavity resonator, the antenna lead extending through the metal cylinder and the ceramic cylinder;

a second metal cylinder coaxially fixed in the first metal cylinder, having a diameter smaller than that of the first metal cylinder, separated from the antenna lead, and constituting a choking structure for choking a harmonic wave together with said first metal cylinder; and a ring-like permanent magnet, arranged around said first metal cylinder, for generating an effective magnetic flux supplied to the interaction space through said pole pieces and a magnetic flux leaking into a space near an inner circumferential wall of said second metal cylinder.

According to one aspect of the invention, there is provided a magnetron having a structure wherein a DC magnetic flux component of the leaking magnetic flux along a radial direction of said second metal cylinder is set not less than 150 gauss in a first region, and the first region occupying ½ the metal cylinder.

According to the second aspect of the invention, there is provided a magnetron having a structure wherein axial components of a DC magnetic flux in a space near an inner circumferential wall of said second metal cylinder are set not less than 400 gauss in most region.

According to the third aspect of the invention there is provided a magnetron. having a structure wherein an axial component of the DC magnetic flux density in the space near the inner circumferential wall of the harmonic wave choking metal cylinder is nonuniform along the circumferential direction.

It is structurally difficult to nullify the DC magnetic field in the space formed between the antenna lead and the harmonic choking metal cylinder located near the antenna lead in a microwave oven magnetron. Since a magnetic flux having a given magnitude is present, a multipactor discharge phenomenon may occur.

In the magnetron according to the first aspect of the present invention, the radial component of the DC magnetic flux density in the space near the inner circumferential wall of the harmonic choking metal cylinder has 150 gauss or more in the region having ½ of the axial length of the choking metal cylinder, i.e., the magnetic field components are not parallel to the tube axis in most of the regions of the inner circumferential wall of the choking metal cylinder. Electrons emitted from the inner circumferential wall of the choking metal cylinder are shifted in the axial direction and tend not to be multiplied. Therefore, in particular, the one-side multipactor discharge phenomenon tends not to continue.

In the magnetron according to the second aspect of the present invention, when the axial component of the DC magnetic flux density in the space near the inner circumferential wall of the harmonic choking metal cylinder has 400 gauss or more in most of the regions, electrons emitted from the antenna lead or the inner circumferential wall of the choking metal cylinder do not reach the wall of the opposite conductor because the axial component of the magnetic field in the space is strong. Therefore, the double-side multipactor discharge phenomenon does not continue.

In the magnetron according to the third aspect of the present invention, when the axial component of the DC magnetic flux density in the space near the inner circumferential wall of the harmonic choking metal cylinder is nonuniform in the circumferential direction, electrons emitted from the inner circumferential wall of the choking metal cylinder have different rotation periods, and the rotation period of the electrons cannot be continuously synchronized with the period of the high frequency electric field. In this manner, a multipactor discharge tends not to occur. Therefore, the multipactor discharges in the space between the antenna lead and the harmonic choking metal cylinder located near the antenna lead are properly suppressed, thereby preventing local overheat and melting.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Microwave oven magnetrons according to embodiments of the present invention will be described with reference to the accompanying drawings.

Figure 4:
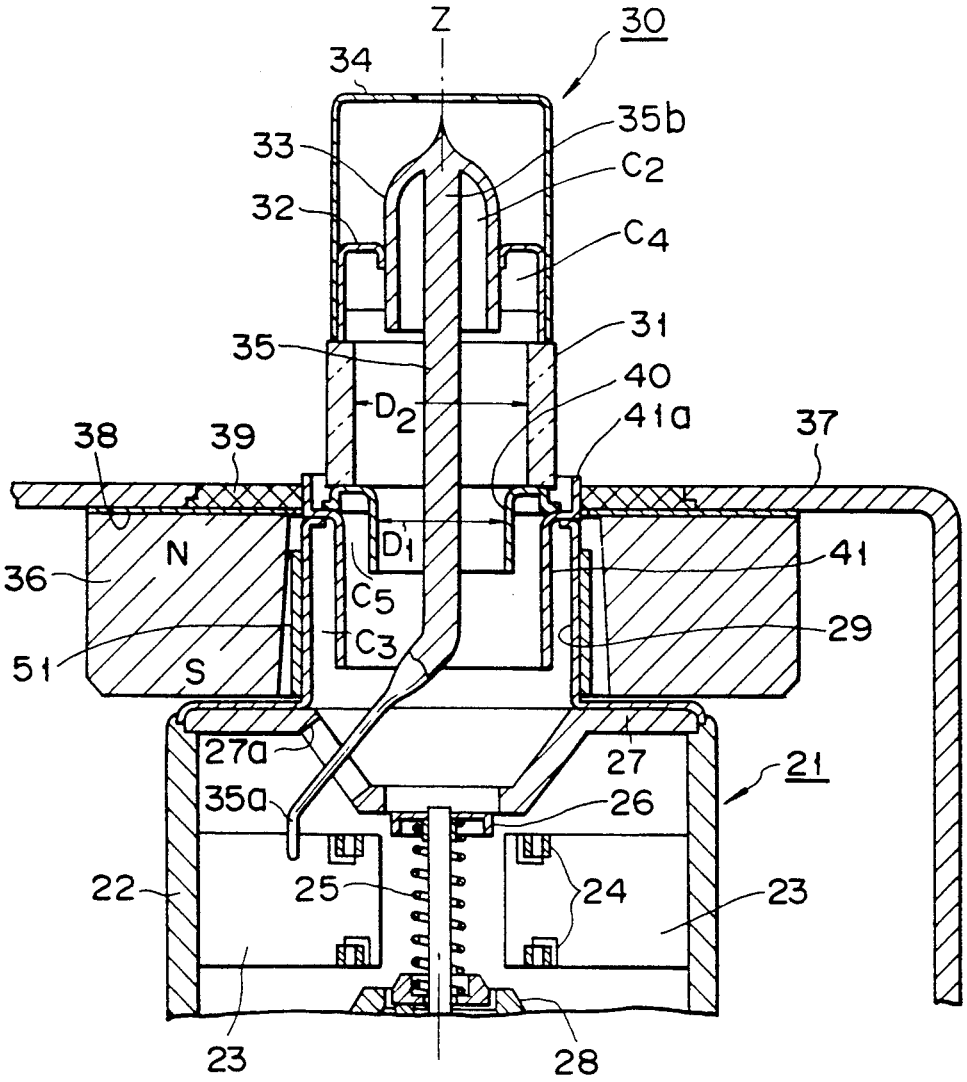
FIG. 4 is a longitudinal sectional view showing a main part of a microwave oven magnetron according to an embodiment of the present invention.

FIG. 4 shows a microwave oven magnetron according to an embodiment of the present invention. The magnetron shown in FIG. 4 has almost the same structure as that of a conventional magnetron. That is, in an oscillator body 21 of the magnetron, a plurality of anode vanes 23 constituting part of a cavity resonator are fixed on the inner surface of an anode cylinder 22. The anode vanes 23 are electrically connected by strap rings 24. A filament cathode 25 extends along the axis of the anode cylinder 22. End shields 26 are arranged at both ends of the filament cathode 25, respectively. Open end portions of the anode cylinder 22 are hermetically sealed by pole pieces 27 and 28, the inner ends of which extend near the end shields 26. An output section cylindrical metal vessel 29 is fixed to the anode cylinder 22. An output section ceramic cylinder 31 of a high frequency output section 30 is fixed to the metal vessel 29. A ring 32, fixed in the ceramic cylinder 31, for sealing the output distal end is arranged in the high frequency output section 30. A metal exhaust tube 33 is hermetically sealed to the inner end of the ring 32, and an output section metal cap 34 is fitted on the outer circumferential surface of the ring 32. An output antenna lead 35 is arranged in the high frequency output section 30. That is, one end portion 35*a* of the antenna lead 35 is electrically connected to one of the vanes. The one end portion 35*a* passes through a through hole 27*a* of the pole piece and then extends through the metal vessel 29 and the ceramic cylinder 31. A distal end portion 35*b* is clamped and hermetically sealed or cold-welded to the metal discharge tube 33. A ring-like permanent magnet 36 coaxially surrounds the metal vessel 29 and is magnetically coupled by a ferromagnetic yoke 37. A ferromagnetic thin plate 38 is interposed between the ferromagnetic yoke 37 and the magnet 36. A net-like conductor gasket 39 is located along the inner circumferential surface of the ferromagnetic yoke 37. A small-diameter metal cylinder 40 is arranged in the lower end portion of the ceramic cylinder 31, and a large-diameter metal cylinder 41 is arranged to surround the cylinder 40. The metal cylinder 41 is brazed to the distal end portion of the metal vessel 29. A distal end 41*a* of the metal cylinder 41 holds the inner circumferential portion of the gasket 39. With this structure, a $\frac{1}{4}$ wavelength choking groove C2 for the second harmonic wave and a groove C4 for choking the fourth harmonic wave are formed in a discharge tube portion. The metal vessel 29 and two metal cylinders 40 and 41 inside the vessel 29 constitute a groove C3 for choking a third harmonic wave and a groove C5 for choking a fifth harmonic wave The choking metal cylinders 40 and 41 are formed by ferromagnetic thin-walled cylinders made of iron or an iron alloy. The metal cylinder 40 for choking the first harmonic wave has an inner diameter Dl smaller than an inner diameter D2 of the ceramic cylinder 31 and has a size smaller than $\frac{1}{2}$ of the fifth harmonic wavelength so as to obtain a sufficient choking action.

Figure 5:
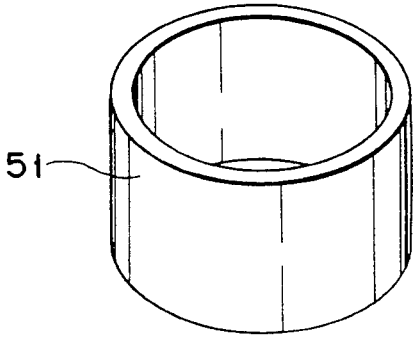
FIG. 5 is a perspective view showing a ferromagnetic cylinder shown in FIG. 4.

Unlike the conventional magnetron, a ferromagnetic cylinder 51 made of iron or an iron alloy (FIG. 5) is arranged between the output section metal vessel 29 and the inner circumferential surface of the doughnut-like ferrite permanent magnet 36 in the magnetron shown in FIG. 4. The sizes of the respective members are given as follows when a microwave oven magnetron has a high frequency output of about 500 W at a fundamental oscillation frequency range of 2,450 MHz. The metal vessel 29 is a ferromagnetic cylinder made of iron or an iron alloy having a thickness of 0.5 mm. Each of the first and second choking metal cylinders 40 and 41 is a ferromagnetic cylinder made of iron or an iron alloy having a thickness of 0.3 mm. The first choking metal cylinder 40 has an inner diameter D1 of 9.0 mm and an axial length of 4.9 mm. The ceramic cylinder 31 has an inner diameter D2 of 12 mm, and the antenna lead 35 is an elliptical rod having a major axis of 3.0 mm. The ferromagnetic cylinder 51 located between the permanent magnet and the metal vessel has a thickness of 0.8 mm and an axial length slightly smaller than that of the permanent magnet. The ferromagnetic cylinder 51 is located near the pole pieces.

Figure 1:
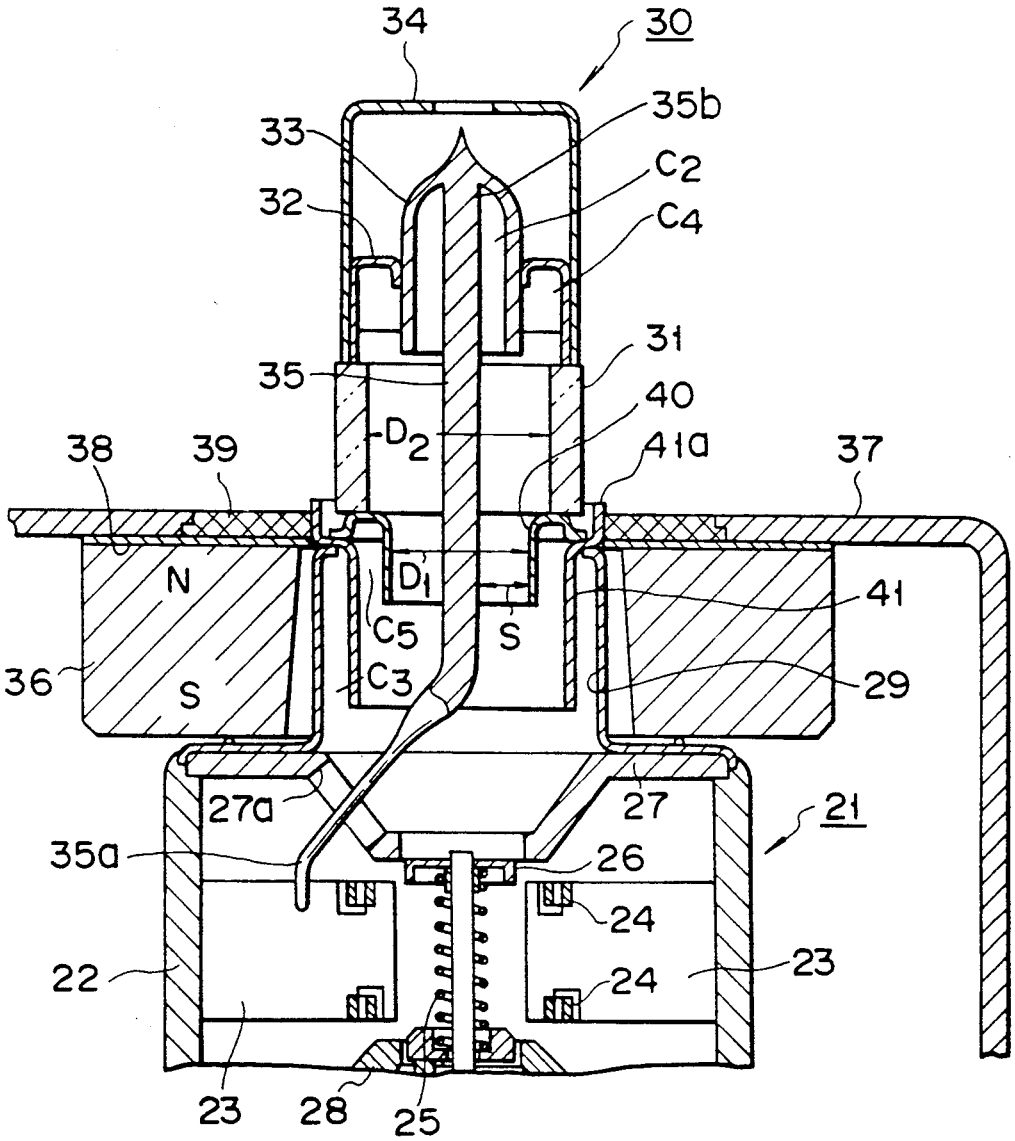
PRIOR ART FIG. 1
FIG. 1 is a longitudinal sectional view showing a main part of a structure of a conventional microwave oven magnetron.
Figure 2:
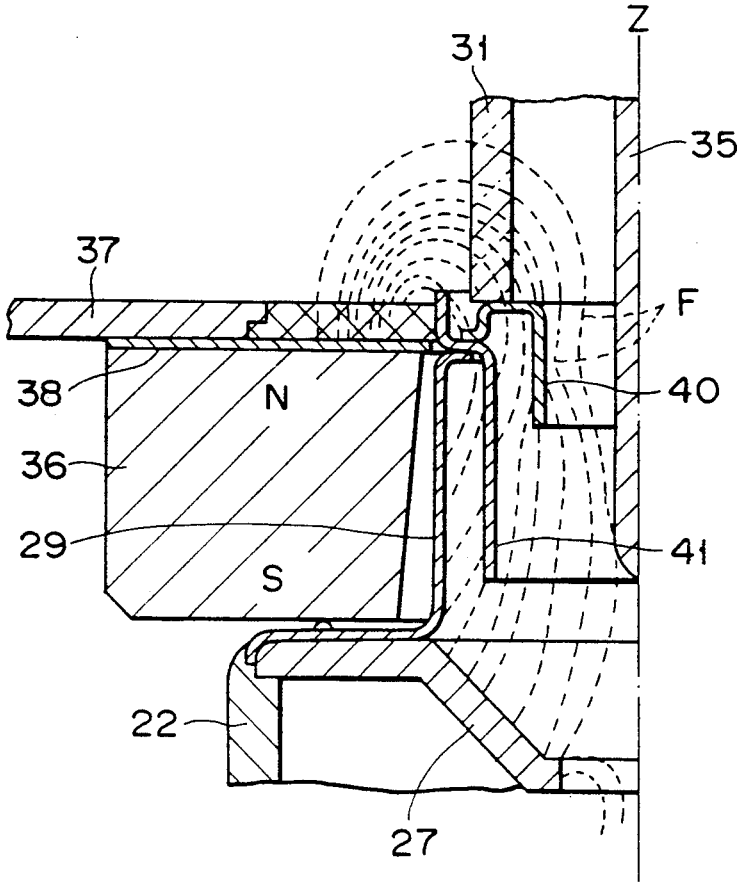
PRIOR ART FIG. 2
FIG. 2 is a view illustrating a magnetic flux distribution near a permanent magnet in the magnetron shown in FIG. 1.
Figure 3:
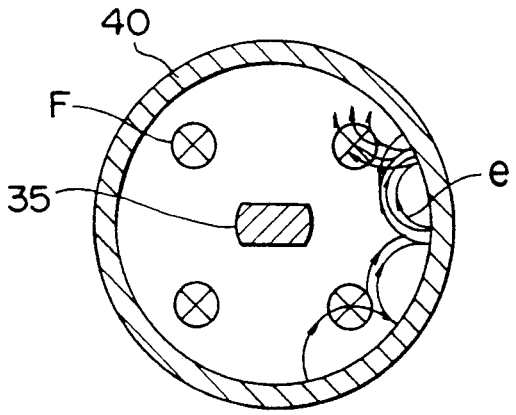
PRIOR ART FIG. 3
FIG. 3 is a view for explaining a high frequency discharge phenomenon occurring in the conventional magnetron.
Figure 6:
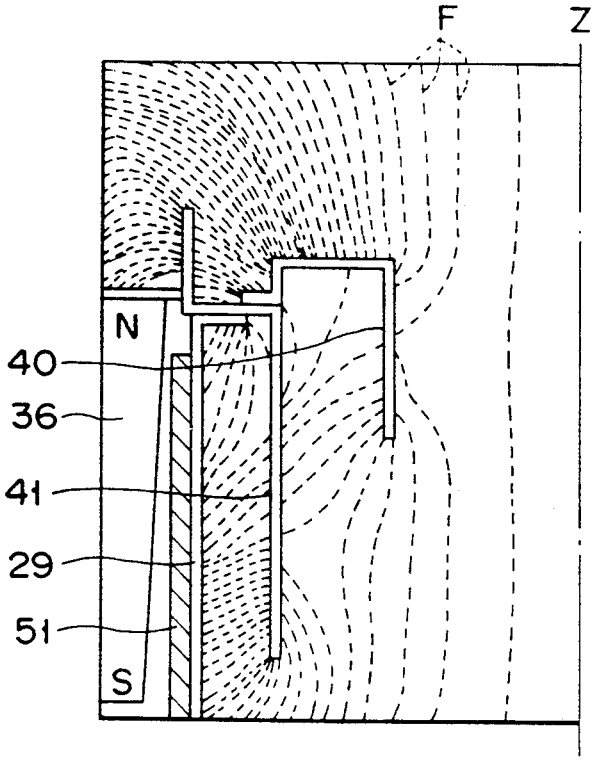
FIG. 6 is a view illustrating a DC magnetic flux distribution near the ferromagnetic cylinder shown in FIG. 4.
Figure 7:
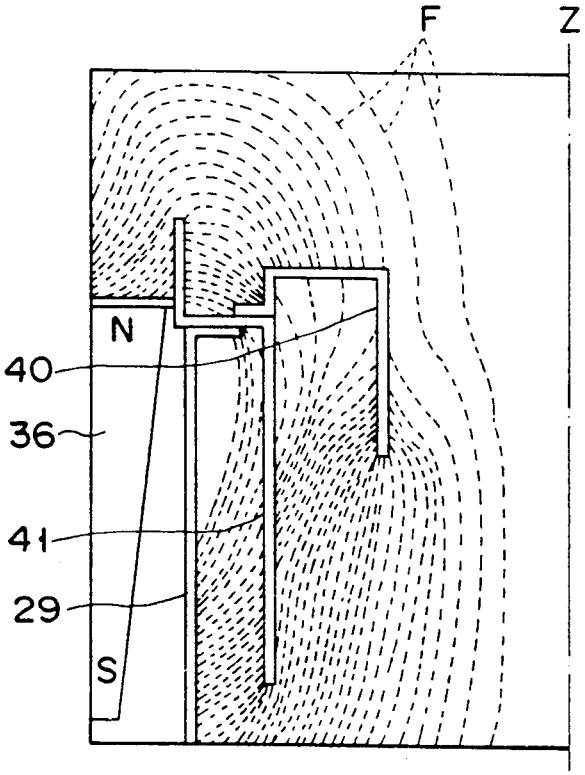
FIG. 7 (PRIOR ART)
FIG. 7 is a view illustrating a DC magnetic flux distribution of a conventional structure as compared with the DC magnetic flux distribution shown in FIG. 6.

A DC magnetic flux in a space inside the metal vessel roughly has a distribution shown in FIG. 6. The conventional structure shown in FIGS. 1 and 2 is shown in FIG. 7 for comparison. The following fact is apparent in this comparison. In the magnetron of this embodiment, DC magnetic fluxes are not parallel to the tube axis in most of the regions of the space near the inner circumferential wall of the first choking metal cylinder along the axial direction of the metal cylinder.

Figure 8:
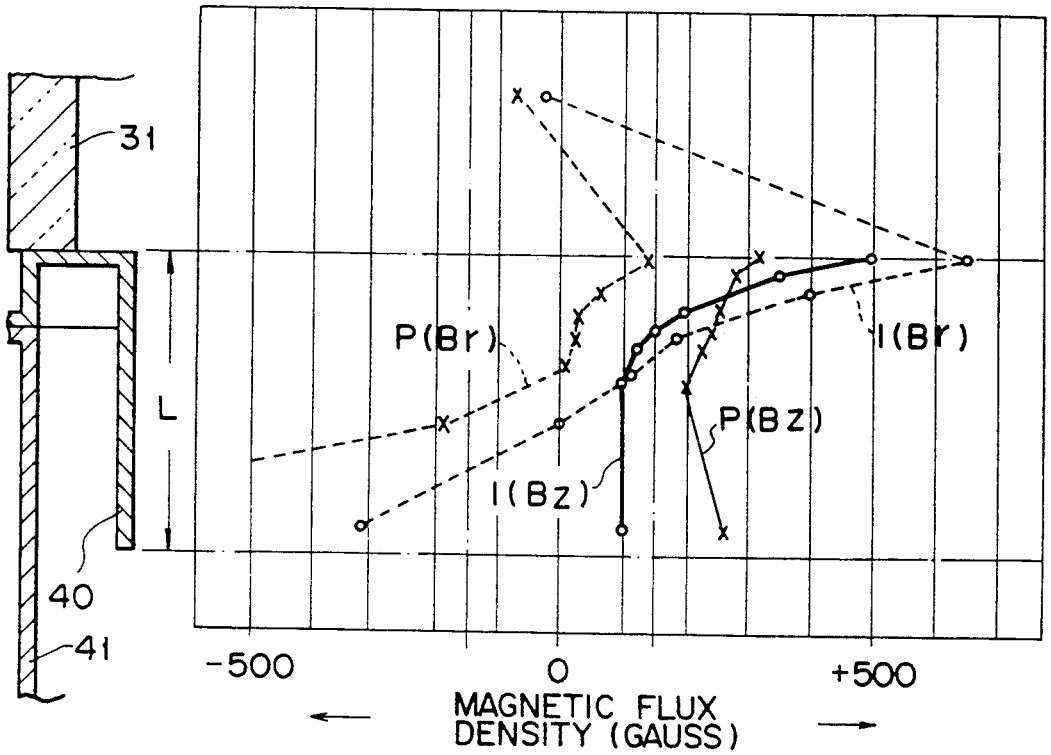
FIG. 8 is a graph showing comparison between magnetic flux distributions.

The magnetic flux density in a spatial position inside the inner circumferential wall surface of the choking metal cylinder by about 0.1 mm can be decomposed into an axial component Bz and a radial component Br, as shown in FIG. 8. Curves I(Bz) and I(Br) represent the axial and radial components of the magnetic flux density in the magnetron of this embodiment. Curves P(Bz) and P(Br) represent axial and radial components of the magnetic flux density of the conventional magnetron shown in FIGS. 1 and 2. The axial positions within the space inside the first choking metal cylinder 40 are plotted along the ordinate. A length L is an axial length of the metal cylinder 40.

Judging from the above results, in the conventional structure, a region in which the radial component of the magnetic flux density near the inner circumferential wall surface of the choking metal cylinder is given as 0±150 gauss, i.e., a region in which the direction of the magnetic field is parallel or almost parallel to the tube axis, occupies about 53% of the length L of the choking metal cylinder. The axial component of the magnetic flux density falls within the range of 200 to 320 gauss. In other words, the region in which the radial component of the magnetic flux density near the inner circumferential wall surface of the choking metal cylinder is given as 150 gauss or more, i.e., the region in which the direction of the magnetic field is not parallel to the tube axis, is only about 47% of the length L of the choking metal cylinder, i.e., less than ½ the length L.

To the contrary, in the magnetron of this embodiment, a region in which the radial component of the magnetic flux density near the inner circumferential wall surface of the choking metal cylinder is given as 0±150 gauss is about 39% of the length L of the choking metal cylinder. The axial components in most of the regions are given as 150 gauss or less. That is, a region in which the radial component of the magnetic flux density near the inner circumferential wall surface of the choking metal cylinder is given as 150 gauss or more, i.e., a region in which the direction of the magnetic field is not parallel to the tube axis, occupies about 61% of the length L of the choking metal cylinder, i.e., ½ or more the length L. The components of the magnetic flux density in the tube axis are given as 150 gauss or less in most of the regions.

As described above, since the magnetic field components are parallel to the tube axis in most of the regions of the space inside the metal cylinder in the conventional structure, a multipactor discharge tends to occur. To the contrary, in the magnetron of this embodiment, the radial component of the magnetic flux density in the space near the inner circumferential wall of the harmonic choking metal cylinder is given as 150 gauss or more in the region exceeding ½ the axial length of the choking metal cylinder. That is, the radial components are not parallel to the tube axis in most of the regions. Therefore, the electrons emitted from the inner circumferential wall surface of the choking metal cylinder are also moved in the axial direction and tend not to be multiplied. Therefore, the multipactor discharge phenomenon does not continue.

When a magnetic flux component parallel to the tube sent, cumulative secondary electrons are multiplied in accordance with a relationship between the high frequency electric field variation period and the electron spinning period. When an axial magnetic field density is increased, a high frequency voltage which causes a multipactor discharge tends to be decreased. However, when the axial magnetic flux density is decreased, a high frequency voltage which causes a multipactor discharge tends to be increased. When a microwave oven magnetron generates a high frequency output of about 500 W at a fundamental oscillation frequency of 2,450 MHz, a high frequency voltage between the antenna lead and the harmonic choking metal cylinder can be estimated to be about 450 V under the condition that high frequency reflection from the load does not occur. However, when high frequency reflection from the load significantly occurs, this high frequency voltage is estimated to exceed 1,000 V. As is known well, in order to set a secondary electron emission ratio of a copper- or iron-based metal being 1 or more, a primary electron energy is required to exceed about 100 eV.

Figure 9:
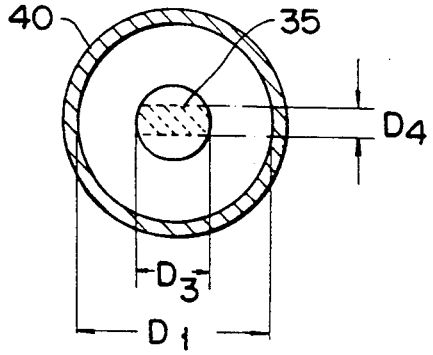
FIG. 9 is a cross-sectional view showing part of a model of the microwave oven magnetron according to the present invention.
Figure 10:
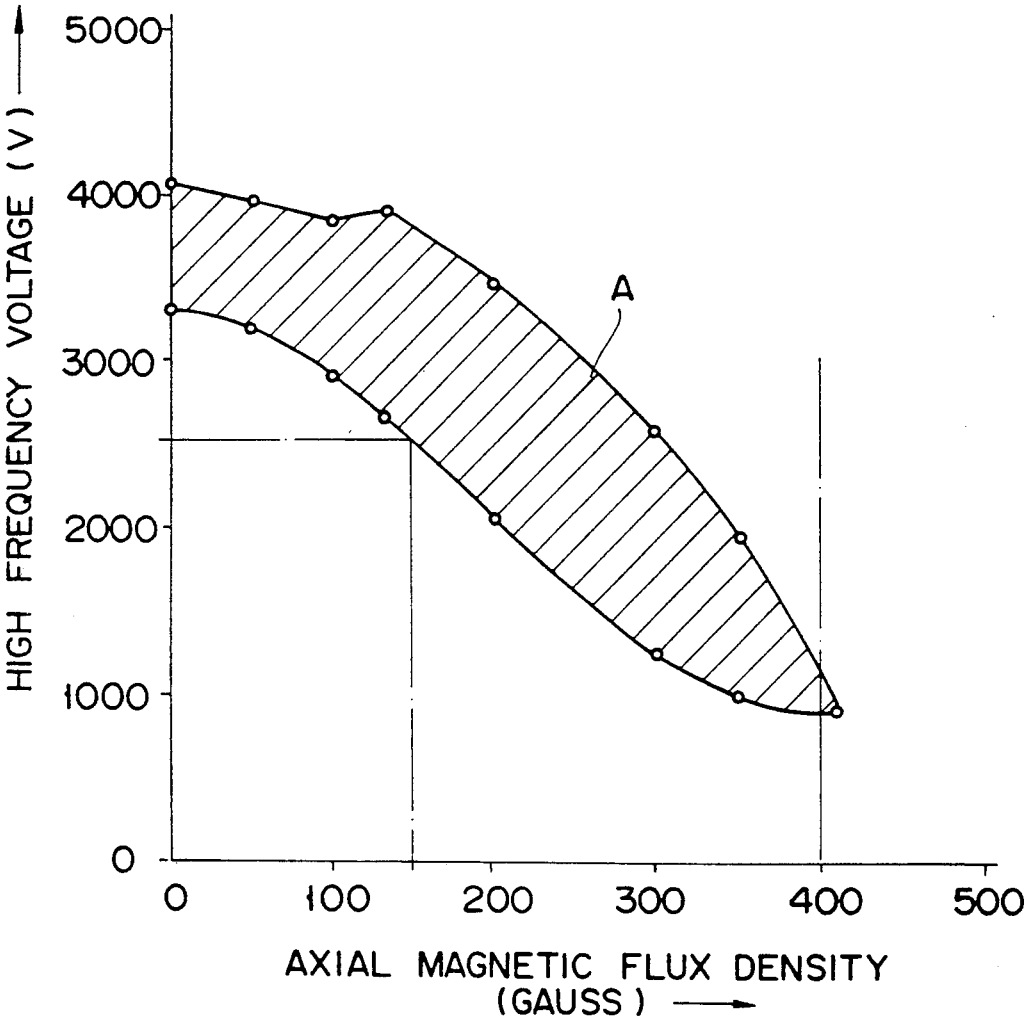
FIG. 10 is a graph showing a relationship between the magnetic flux density and the high frequency voltage.

High frequency voltages which cause multipactor discharges for axial magnetic flux densities are calculated and summarized, as shown in FIG. 10. As shown in FIG. 9, the first harmonic choking metal cylinder 40 has an inner diameter D1 of 9.0 mm, and the antenna lead 35 comprises an elliptical rod having a major axis D3 of 3.0 mm and a minor axis D4 of 1.2 mm. In the above calculations, the major and minor axes are averaged, and the average value is replaced with the diameter D3 of a circular section. The calculations are also based on an assumption that a radial component of the magnetic flux is given as 0. As shown in FIG. 10, high frequency voltages which cause multipactor discharges for axial magnetic flux densities plotted along the abscissa so as to cause an energy of electrons colliding against the conductor surface to exceed 100 eV are plotted. These high frequency voltages fall within a hatched region A. When the magnetic flux densities in most of the regions along the a is of the choking metal cylinder along the axial direction of the space between the two conductors are set to be 400 gauss or more, the multipactor discharge can be perfectly suppressed.

In the first structure, the metal cylinders 40 and 41 for choking the first and second harmonic waves are integrally formed by a nonmagnetic material having a specific permeability of 1 or near 1. In this structure, the magnetic flux densities can be set to be 400 gauss or more in most of the regions of the space near the inner circumferential surface wall of the first harmonic choking metal cylinder 40 along the tube axis Z. Note that the sealing metal ring to be hermetically brazed to the output ceramic cylinder 31 may be formed of an iron alloy such as Kovar (tradename) independently of the choking metal cylinder 40, and the metal vessel 29 may be made of a nonmagnetic material but may preferably be made of iron or an iron alloy in favor of mechanical strength and cost. In the second structure, an auxiliary permanent magnet ring having a relatively small size may be located near the gasket ring 39.

Even if a large amount of reflection is present depending on practical operating conditions of a microwave oven, a maximum high frequency voltage across the two conductors is assumed to be about 2,500 V. As is apparent from FIG. 10, when the magnetic flux density component near the inner circumferential wall surface of the choking metal cylinder 40 along the axial direction is set to be about 150 gauss or less in most of the regions in the axial direction, the multipactor discharges can be greatly suppressed.

When the radial components are set to be 150 gauss or more so that the magnetic fluxes in the space between the conductors are not parallel to the tube axis in ½ or more, and more preferably, ⅔ or more of the regions, or when the axial components of the magnetic flux density in the remaining regions except for the above nonparallel regions are set to be 150 gauss or less, generation of secondary electrons generated in the space between the antenna lead and the surrounding harmonic choking metal cylinder and accumulated on the inner surface of the metal cylinder can be suppressed. Even if a high frequency voltage in this space is abnormally increased, generation or continuation of the multipactor discharge can be properly suppressed, and overheat and melting of the constituting components do not occur. Therefore, a highly reliable stable operation can be obtained in a relatively simple structure.

Figure 11:
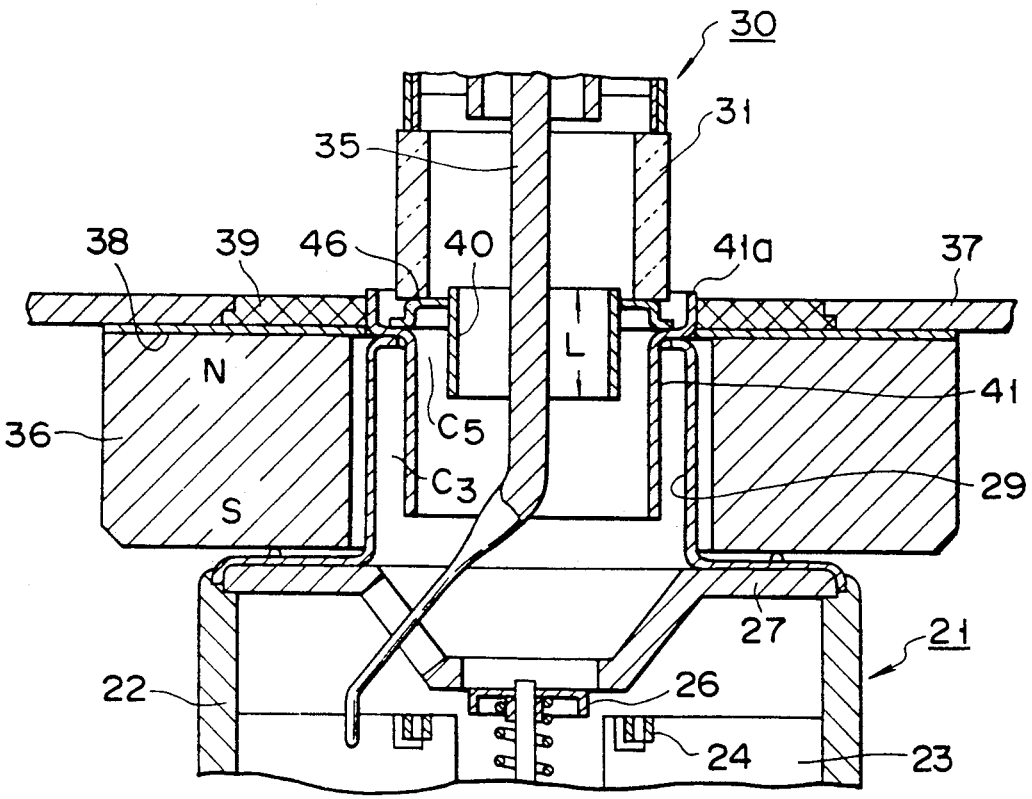
FIG. 11 is a longitudinal sectional view showing part of a magnetron according to another embodiment of the present invention.

In an embodiment shown in FIG. 11, a magnetic flux in a space between two conductors is set not to be parallel to a tube axis in most of regions in the axial direction. That is, a sealing metal ring 46 to be hermetically brazed to an output section ceramic cylinder 31 is made of a ferromagnetic material such as iron. A first harmonic choking metal cylinder 40 fixed inside the metal ring 46 is made of a nonmagnetic material such as copper having a relative permeability of 1 or near 1. Most of the DC magnetic fluxes in the space inside the choking metal cylinder 40 pass through the ferromagnetic sealing metal ring 46, so that radial components of the magnetic flux density are not parallel to the tube axis to be given as 150 gauss or more in most of the regions exceeding ½ an axial length L of the choking metal cylinder. Generation and accumulation of the multipactor discharges can be suppressed. In addition, when the axial components in the remaining regions are set as small as 150 gauss or less, this suppression effect can be further enhanced.

Figure 12:
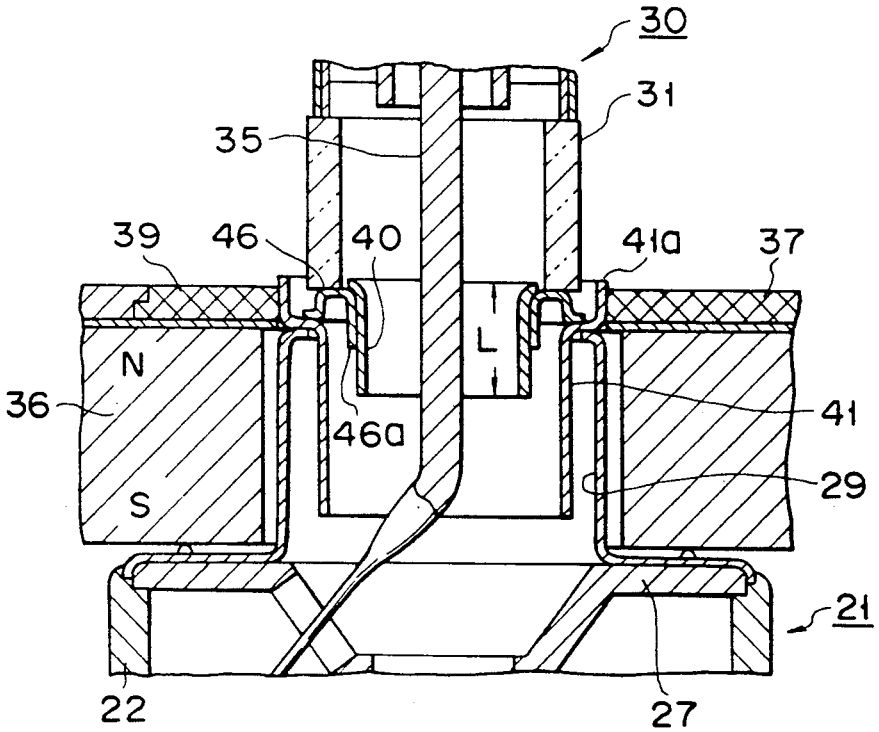
FIG. 12 is a longitudinal sectional view showing part of a magnetron according to still another embodiment of the present invention.

In an embodiment shown in FIG. 12, a portion inside a sealing metal ring 46 made of a ferromagnetic material is axially bent to form a cylindrical portion 46*a*. This cylindrical portion 46*a* extends downward (FIG. 12) along the outer circumferential surface of a choking metal cylinder 40. With this arrangement, magnetic fluxes are set not to be parallel to the tube axis in regions exceeding ½ the internal area of the choking metal cylinder.

As in the embodiments shown in FIGS. 11 and 12, the harmonic choking metal cylinder having a relatively small diameter to surround the antenna lead with a gap is made of a nonmagnetic material. A ring member which supports this metal cylinder is made of a ferromagnetic material. The magnetic flux distribution of the internal area of the choking metal cylinder can be set, as described above.

In each of the embodiments described above, the ferromagnetic cylinder is located outside or inside the metal vessel 29. However, to prevent magnetic saturation, at least one of the choking metal cylinders 40 and 41 may have a thick wall having a thickness of 0.8 mm or more. Then, generation and continuation of the high frequency discharges can be suppressed by substantially the same magnetic field distribution as in the above embodiments.

Figure 13:
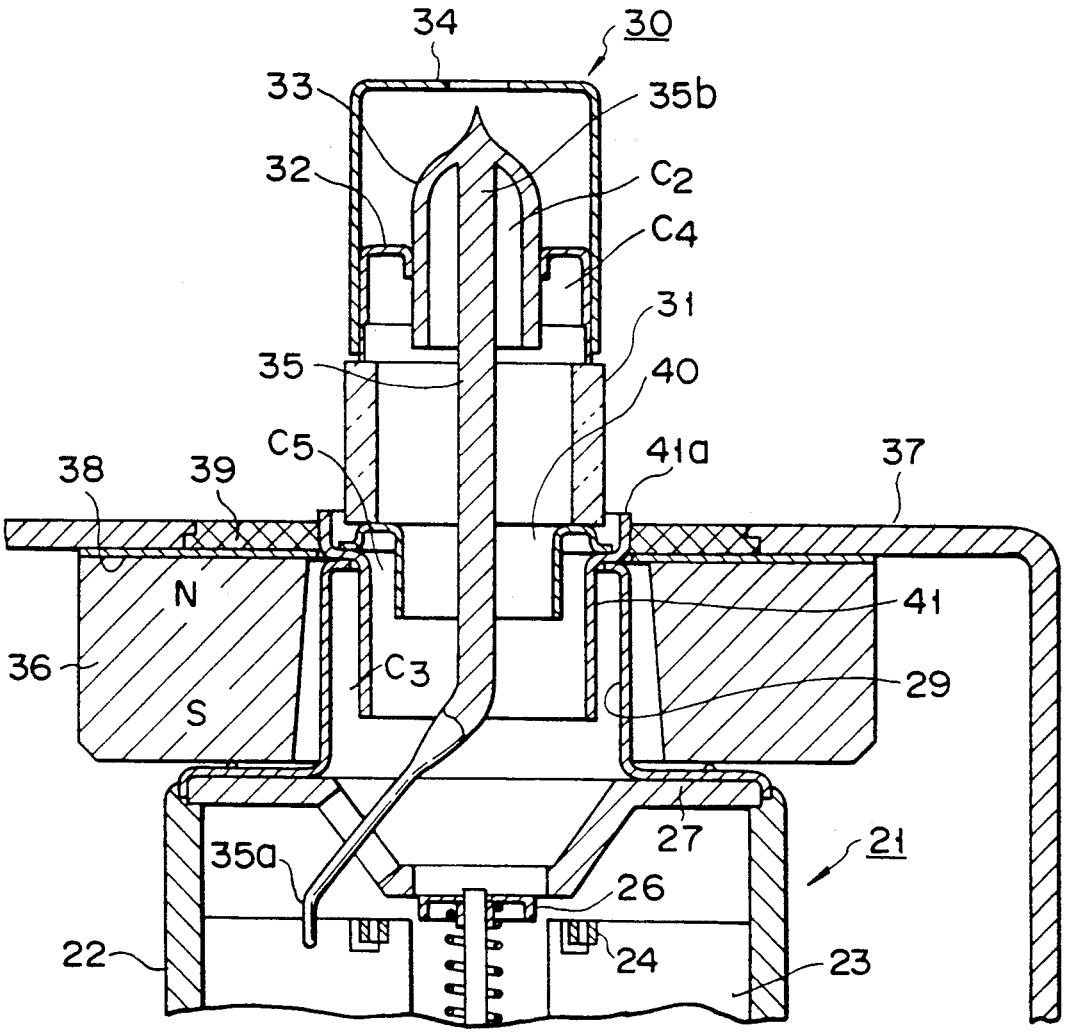
FIG. 13 is a longitudinal sectional view showing part of a magnetron according to still another embodiment of the present invention.

In an embodiment shown in FIG. 13, a ferromagnetic cylinder having a relatively large wall thickness is located inside a metal vessel 29. That is, a choking metal cylinder 41 for suppressing the third harmonic wave is made of a ferromagnetic member having a wall thickness of 0.6 mm. A metal cylinder 40, located inside the metal cylinder 41, for choking the fifth harmonic wave is made of a ferromagnetic member having a wall thickness of 0.3 mm.

The magnetic flux density in the space near the inner circumferential wall surface of the metal cylinder 40 for choking the fifth harmonic wave can be distributed in the same manner as in the previous embodiments.

In each embodiment described above, all or parts of the cylinder for choking the first and second harmonic waves may be made of a so-called nonmagnetic material.

Figure 14:
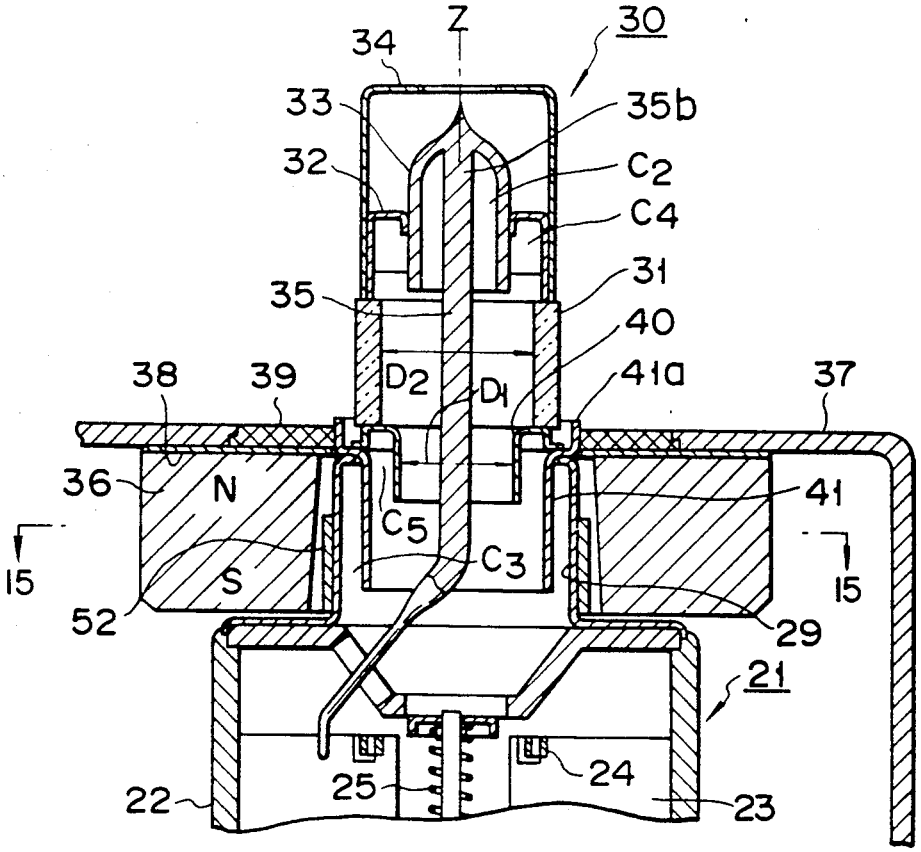
FIG. 14 is a longitudinal sectional view showing part of a magnetron according to still another embodiment of the present invention.
Figure 15:
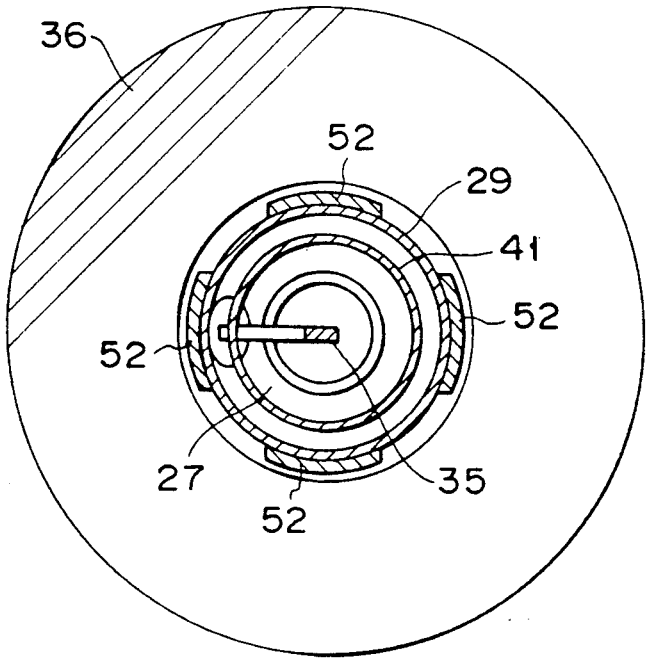
FIG. 15 is a cross-sectional view of the magnetron along the line 15—15 of FIG. 14.
Figure 16:
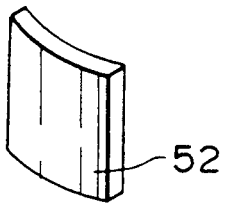
FIG. 16 is a perspective view showing a ferromagnetic piece shown in FIGS. 14 and 15.

In an embodiment shown in FIGS. 14 to 16, axial components of a DC magnetic flux density in a space near the inner circumferential wall surface of a harmonic choking metal cylinder have a nonuniform distribution along the circumferential direction. More specifically, four ferromagnetic pieces 52 made of iron or an iron alloy are equidistantly arranged between a metal vessel 29 and the inner circumferential wall surface of a permanent magnet 36. Each ferromagnetic piece 52 is made of a plate having a size slightly smaller than the axial length of the permanent magnet 36 and a thickness of 1.0 mm. These ferromagnetic pieces are formed to have an arcuated shape so as to surround the outer circumferential surface of the metal vessel 29 and are fixed by welding to the metal vessel so as to come close to the pole pieces.

With the above structure, a DC magnetic flux leaking from the permanent magnet has a nonuniform axial distribution in the space near the inner circumferential surface of the metal cylinder 40 for choking the first harmonic wave in the circumferential direction by means of the plurality of equidistant ferromagnetic pieces 52 which surround the outer circumferential surface of the metal vessel. For this reason, the rotating period of the emission electrons has a nonuniform period in the space within the metal cylinder in the circumferential direction. Therefore, the electron rotating period cannot be continuously synchronized with the period of the high frequency electric field. Generation and continuation of the multipactor discharge thus become difficult.

Figure 17:
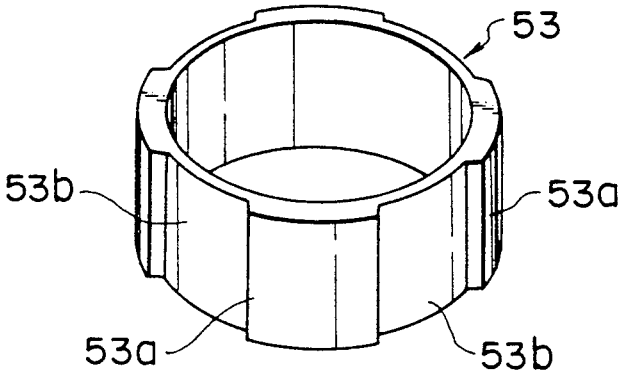
FIG. 17 is a perspective view showing a ferromagnetic cylinder of a magnetron according to still another embodiment of the present invention.

In an embodiment shown in FIG. 17, a ferromagnetic cylinder 53 is constituted by thick- and thin-walled portions 53*a* and 53*b* alternately formed in the circumferential direction. The thick-walled portion 53*a* has a thickness of, e.g., 0.8 mm, and the thin-walled portion 53*b* has a thickness of, e.g., 0.3 mm. When the thick- and thin-walled portions 53*a* and 53*b* are fitted to surround the outer circumferential surface of the metal vessel 29, a magnetic field in the space within the choking metal cylinder has a nonuniform axial distribution substantially as in the above embodiments. The embodiment in FIG. 17 is relatively easy to assemble.

In the embodiments described above, the ferromagnetic pieces or plates or a cylinder is arranged to surround the metal vessel 29. However, the present invention is not limited to this. For example, the wall thickness of the metal vessel 29 may be locally changed. Generation and continuation of the high frequency discharge can be suppressed by substantially the same magnetic field distributions of the above embodiments. In addition, in each embodiment described above, all or parts of the metal vessel, and the choking cylinders for choking the first an second harmonic waves may be made of a nonmagnetic material.

Figure 18:
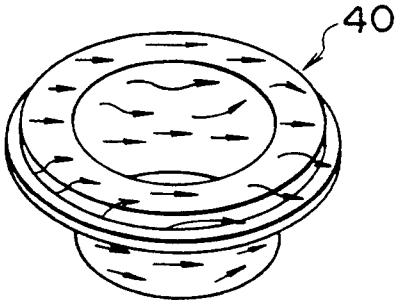
FIG. 18 is a perspective view showing a main part of a metal cylinder of a magnetron according to still another embodiment of the present invention.

In an embodiment shown in FIG. 18, a metal cylinder 40 for choking the first harmonic wave is a member obtained by pressing a metal material (e.g., a grain oriented silicon steel plate) having directional permeability. A direction indicating a higher permeability is indicated by an arrow in FIG. 18. An axial magnetic flux density in the space inside the choking metal cylinder can be nonuniform in the circumferential direction, thereby suppressing generation of the high frequency discharge.

Figure 19:
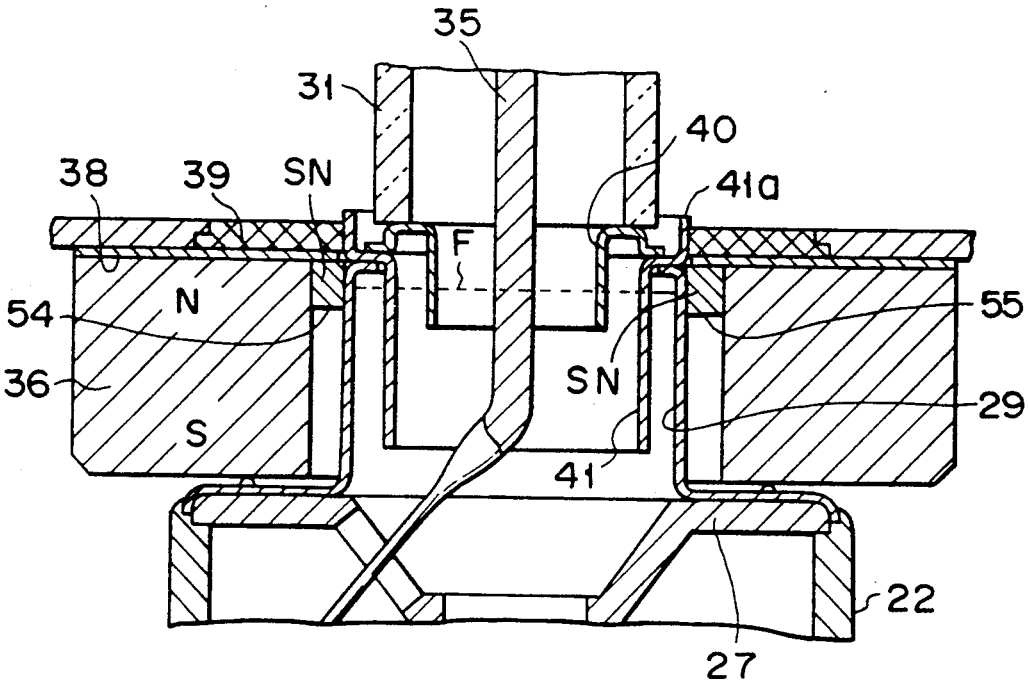
FIG. 19 is a longitudinal sectional view of a magnetron according to still another embodiment of the present invention.
Figure 20:
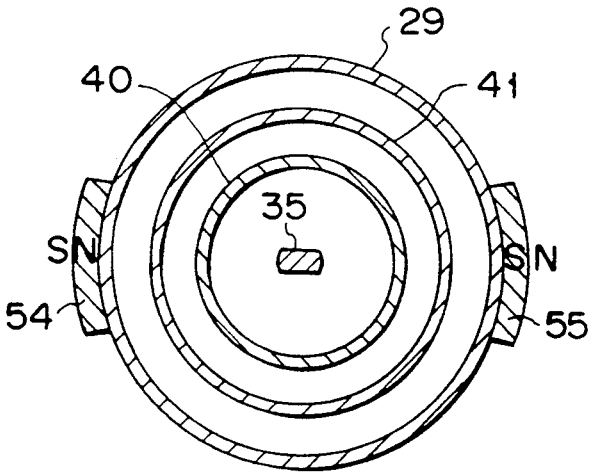
FIG. 20 is a cross-sectional view of FIG. 19.

In an embodiment shown in FIGS. 19 and 20, permanent magnets 54 and 55 are arranged between a metal vessel 29 and a permanent magnet 36 corresponding to the metal cylinder 40. These magnetic pieces 54 and 55 are magnetized in the lateral direction in FIG. 19 and generate a radial magnetic field component F to a space inside the choking metal cylinder 40. The axial component of the magnetic flux in the space inside the choking metal cylinder has a distribution which is irregularly changed in the circumferential direction when an amount of radial components is increased. A multipactor discharge is difficult to occur as described above. In this embodiment, a sufficiently nonuniform magnetic field distribution can be obtained by using the permanent magnet having a relatively small size.

The DC magnetic field in the space immediately inside the choking metal cylinder can be set to fall within the scope of the claims by various combinations anticipated from the above description. In the above embodiments, accessories of the ferromagnetic member and magnet can be arranged in the space inside the metal vessel 19.

According to the present invention, as has been described above, generation and continuation of multipactor discharges in the space between the antenna lead and the harmonic choking metal cylinder having a relatively small diameter can be eliminated. Overheat and melting of the constituting components can be eliminated. A highly reliable stable operation can be obtained by a relatively simple structure.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A microwave oven magnetron for generating a microwave comprising:

an anode cylinder having an inner surface, first and second open and portions and a center axis;

a cathode located along the center axis of said anode cylinder;

a plurality of anode vanes constituting part of a cavity resonator are fixed on said inner surface of said anode cylinder radially projecting towards said cathode, an interaction space being defined between said anode vanes and said cathode;

first and second pole pieces fixed on said first and second open end portions, respectively;

a first metal cylinder having first and second ends, an inner diameter and a length, said first end of said first metal cylinder being provided on said first pole piece;

an output section ceramic cylinder coupled to said second end of said first metal cylinder;

an antenna lead having a first and second end, said first end of said antenna lead being electrically connected to said cavity resonator, said antenna lead extending through said first metal cylinder and said ceramic cylinder;

a second metal cylinder having a length and an inner surface, said second metal cylinder coaxially fixed in said first metal cylinder and separated from said antenna lead, said second metal cylinder having an inner diameter smaller than the inner diameter of said fit metal cylinder, said second metal cylinder constituting a choking structure for choking a harmonic wave of the microwave together with said first metal cylinder;

an annular permanent magnet, surrounding said first metal cylinder, for generating an effective magnetic flux supplied to the interaction space through said first pole piece and a leakage magnetic flux leaking into an inner space at a location near said inner surface of said second metal cylinder; and means, magnetically coupled with said annular permanent magnet, for maintaining in a first region a DC magnetic flux component of the leakage magnetic flux along a radial direction of said second metal cylinder, normal to the center axis of said anode cylinder, at greater than or equal to 150 gauss, said first region occupying over ½ the length of said second metal cylinder.

2. A magnetron according to claim 1, wherein said maintaining means maintains an axial component of the leakage magnetic flux in a second region, located excluding said first region, near an inner circumferential wall of said second metal cylinder at less than or equal to 150 gauss.

3. A magnetron according to claim 1, wherein said maintaining means includes a ferromagnetic cylinder arranged between an inner circumferential surface of said annular permanent magnet and said fist metal cylinder.

4. A magnetron according to claim 1, wherein said maintaining means includes a ferromagnetic cylinder arranged inside said first metal cylinder.

5. A magnetron according to claim 1, wherein said maintaining means includes a third metal cylinder for realizing a harmonic choking structure including a ferromagnetic material and said third metal cylinder is arranged inside said first metal cylinder.

6. A magnetron according to claim 5, wherein said maintaining means further comprises a section having a thickness which is larger than a thickness which is associated with one of said second and third metal cylinders, said section is disposed in the other one of said second and third metal cylinders.

7. A magnetron according to claim 1, wherein said second metal cylinder includes a nonmagnetic material having a relative permeability of approximately 1, and said maintaining means includes a ferromagnetic annular member for supporting said second metal cylinder.

8. A magnetron according to claim 1, wherein said second metal cylinder includes a metal material having directional permeability.

9. A microwave oven magnetron for generating a microwave comprising:

an anode cylinder having an inner surface, first and second open end portions and a center axis;

a cathode located along the center axis of said anode cylinder;

a plurality of anode vanes constituting part of a cavity resonator are fixed on said inner surface of said anode cylinder radially projecting towards said cathode, an interaction space being defined between said anode vanes and said cathode;

first and second pole pieces fixed on said first and second open end portions, respectively;

a first metal cylinder having first and second ends, an inner diameter and a length, said first end of said first metal cylinder being provided on said first pole piece;

an output section ceramic cylinder coupled to said second end of said first metal cylinder;

an antenna lead having a first and second end, said first end of said antenna lead being electrically connected to said cavity resonator, said antenna lead extending through said first metal cylinder and said ceramic cylinder;

a second metal cylinder having an inner surface, said second metal cylinder coaxially fixed in said firs metal cylinder and separated from said antenna lead, said second magnetic cylinder having an inner diameter smaller than the inner diameter of said first metal cylinder, said second metal cylinder constituting a choking structure for choking a harmonic wave of the microwave together with said first metal cylinder;

an annular permanent magnet, surrounding said first metal cylinder, for generating an effective magnetic flux supplied to the interaction space through said first pole piece and a leakage magnetic flux leaking into a space above said second metal cylinder; and means, magnetically coupled with said annular permanent magnet, for maintaining a DC magnetic flux component of the leakage magnetic flux along an axial direction of said second metal cylinder in an inner space located near said inner surface of said second metal cylinder at greater than or equal to 400 gauss in over half a volume of said inner space.

10. A magnetron according to claim 9, wherein said second metal cylinder include a nonmagnetic material having a relative permeability of approximately 1.

11. A magnetron according to claim 9, wherein said second metal cylinder includes a metal material having directional permeability.

12. A microwave oven magnetron for generating a microwave comprising:

an anode cylinder having an inner surface, first and second open end portions and a center axis;

a cathode located along the center axis of said anode cylinder;

a plurality of anode vanes constituting part of a cavity resonator are fixed on said inner surface of said anode cylinder radially projecting towards said cathode, an interaction space being defined between said anode vanes and said cathode;

first and second pole pieces fixed on said first and second open end portions, respectively;

a first metal cylinder having first and second ends an inner diameter and a length, said first end of said first metal cylinder being provided on said first pole piece;

an output section ceramic cylinder coupled to said second end of said first metal cylinder;

an antenna lead having a first and second end, said first end of said antenna lead being electrically connected to said cavity resonator, said antenna lead extending through said first metal cylinder and said ceramic cylinder;

a second metal cylinder having an inner surface, said second metal cylinder coaxially fixed in said first metal cylinder and separated from said antenna lead, said second metal cylinder having an inner diameter smaller than the inner diameter of said first metal cylinder, said second metal cylinder constituting a choking structure for choking a harmonic wave of the microwave together with said first metal cylinder;

an annular permanent magnet, surrounding said first metal cylinder, for generating an effective magnetic flux supplied to the interaction space through said first pole piece and a leakage magnetic flux leaking into a space around said second metal cylinder; and means, magnetically coupled to said annular permanent magnet, for maintaining a DC magnetic flux component of the leakage magnetic flux along an axial direction of said second metal cylinder in an inner space located near an inner surface of said second metal cylinder nonuniform in a circumferential direction of said second metal cylinder.

13. A magnetron according to claim 12, wherein said maintaining means includes a plurality of ferromagnetic pieces spaced apart from each other along an outer circumferential surface of said first metal cylinder.

14. A magnetron according to claim 12, wherein said maintaining means includes a plurality of ferromagnetic pieces spaced apart from each other inside said first metal cylinder.

15. A magnetron according to claim 12, wherein said maintaining means includes a ferromagnetic cylinder having a nonuniform wall thickness and surrounding said first metal cylinder.

16. A magnetron according to claim 12, wherein said maintaining means includes a ferromagnetic cylinder having a nonuniform wall thickness and arranged inside said first metal cylinder.

17. A magnetron according to claim 12, wherein said maintaining means includes a permanent magnet piece arranged outside said first metal cylinder.

18. A magnetron according to claim 12, wherein said second metal cylinder includes a metal material having directional permeability.

* * * * *